US010717566B1

(12) United States Patent
Williams

(10) Patent No.: US 10,717,566 B1
(45) Date of Patent: Jul. 21, 2020

(54) ERECTING SPOUT CAP

(71) Applicant: Johnathan James Williams, Houston, TX (US)

(72) Inventor: Johnathan James Williams, Houston, TX (US)

(73) Assignee: Johnathan Williams, Houston, TX (US)

( * ) Notice: Subject to any disclaimer, the term of this patent is extended or adjusted under 35 U.S.C. 154(b) by 0 days.

(21) Appl. No.: 16/501,827

(22) Filed: Jun. 11, 2019

(51) Int. Cl.
*B65D 47/08* (2006.01)

(52) U.S. Cl.
CPC ..... *B65D 47/0866* (2013.01)

(58) Field of Classification Search
CPC ..... B67D 47/0866
USPC ..... 222/530
See application file for complete search history.

(56) References Cited

U.S. PATENT DOCUMENTS 130,208 A 8/1872 Frank
135,267 A 1/1873 Cumings
158,406 A 1/1875 Quillfeldt
3,093,273 A * 6/1963 Borah ..... B65D 47/063 222/527
3,298,577 A * 1/1967 Chlystun ..... B65D 25/44 222/529
3,310,191 A 3/1967 Kern
3,690,522 A * 9/1972 Chlystun ..... B65D 25/44 222/529
4,073,413 A * 2/1978 Tabler ..... B65D 47/063 222/529
4,114,778 A 9/1978 O'Neal
4,394,918 A 7/1983 Grussen
4,403,709 A * 9/1983 Meins ..... B65D 25/42 220/229
4,415,097 A * 11/1983 Meins ..... B65D 25/42 220/711
4,440,327 A * 4/1984 Dark ..... B29C 33/442 222/530
4,560,081 A * 12/1985 Adams ..... B65D 47/063 220/260
4,726,491 A * 2/1988 Moon ..... B65D 25/44 222/1
D331,348 S * 12/1992 Park ..... D7/300.2
5,203,468 A * 4/1993 Hsu ..... A47G 19/2272 220/254.3

(Continued)

FOREIGN PATENT DOCUMENTS

KR 880003342 B4 9/1998
KR 880003342 Y1 9/1998

*Primary Examiner* — Patrick M. Buechner
*Assistant Examiner* — Michael J. Melaragno

(57) ABSTRACT

The disclosure concerns an erecting spout cap for pouring liquid from containers without removal of the cap itself. The erecting spout cap comprises a lever in the outer lining of the cap embodiment, a memory recoil tongue, and a spout embedded in the casing of the cap, wherein relieving the use of two hands to open and close liquid containers. The lever is engaged with one finger which slides the seal of the cap open. The inner annular wall comprises a concave means to align the erecting spout cap with a stopper material. The serving spout comprises a type of "funnel" to precede passing liquid. An erecting and auto-retracting spout in a closure article thus secures liquid contents from foreign objects and provides a direct and accurate pour.

11 Claims, 7 Drawing Sheets

(56) References Cited

U.S. PATENT DOCUMENTS 5,259,538 A * 11/1993 Tardif ..... B65D 47/2043 222/528
5,273,172 A * 12/1993 Rossbach ..... B65D 47/2043 215/229
5,346,081 A * 9/1994 Lin ..... B65D 47/066 215/229
5,348,201 A 9/1994 Koo
5,392,968 A * 2/1995 Dark ..... B65D 47/066 222/528
5,607,086 A * 3/1997 Gooch ..... B65D 47/061 222/525
5,819,972 A * 10/1998 Puente Pubill ..... B65D 25/44 220/255
6,161,728 A * 12/2000 Dark ..... B65D 47/066 222/153.07
6,196,413 B1 * 3/2001 Tung ..... B65D 47/0885 215/229
6,237,817 B1 * 5/2001 Son ..... B65D 25/44 222/527
6,609,624 B2 * 8/2003 Goto ..... A47G 19/2266 220/259.1
6,619,518 B1 * 9/2003 Lee ..... B65D 47/066 222/529
7,097,065 B2 * 8/2006 Yoneoka ..... A47G 19/2266 220/203.06
8,550,269 B2 10/2013 Lane
8,827,106 B2 * 9/2014 Windmiller ..... B65D 1/06 220/709
9,380,898 B2 * 7/2016 Mason ..... B65D 47/08
10,117,533 B2 * 11/2018 Chen ..... A47G 19/2272
10,336,510 B2 * 7/2019 El-Saden ..... A47G 19/2266
2002/0170874 A1 * 11/2002 Hou ..... A47G 19/2266 215/229
2003/0102318 A1 * 6/2003 Lee ..... B65D 47/066 220/705
2005/0029271 A1 * 2/2005 McDonough ..... A47G 19/2266 220/709
2005/0133505 A1 * 6/2005 Yoneoka ..... A47G 19/2266 220/254.3
2007/0056996 A1 * 3/2007 Zijing ..... B65D 17/4012 222/530
2010/0237033 A1 * 9/2010 Windmiller ..... B65D 1/06 215/2
2012/0228315 A1 * 9/2012 Davies ..... B65D 47/065 220/715
2013/0008902 A1 * 1/2013 Davies ..... A47G 19/2272 220/254.1

* cited by examiner

ERECTING SPOUT CAP

CROSS REFERENCE TO RELATED APPLICATIONS

This application claims the benefit of provisional patent application Ser. No. 62/764,084, filed 2018 Jul. 18 by the present inventor, which is incorporated by reference in its entirety.

BACKGROUND

Field of Invention

This application relates to a closure article for liquid containers such as bottles, jugs and tanks and relates to a modified means of serving liquid through the closure without the removal of the closure. The present embodiment also relates to fingertip touch operations for both service and closure means.

Prior Art

The following is a tabulation of some prior art that presently appears relevant:

| U. S. Patents | | | |
|---|---|---|---|
| Pat. No. | Kind Code | Issue Date | Patentee |
| 130,208 | B | 1872 Aug. 06 | Frank, H. |
| 135,267 | B1 | 1873 Jan. 28 | Cumings, D. M. |
| 158,406 | B2 | 1875 Jan. 05 | de Quillfeldt, C. |
| 3,310,191 | B | 1967 Mar. 21 | Kern/Hans Peter |
| 4,114,778 | B4 | 1978 Sep. 19 | O'Neal, Chester L. |
| 4,394,918 | B3 | 1983 Jul. 27 | Grussen, Jean |
| KR880003342Y1 | B4 | 1988 Sep. 24 | Park, Se-chang |
| 5,384,201 | B2 | 1994 Sep. 20 | Koo, James Y. C. |
| 8,550,269 | B2 | 2013 Oct. 08 | Thermos, LLC |

Prior Art

Liquids originally were carried around in pales and served hand to hand with cups or goblets. These pales were then discarded to the side, allowing for bugs and aerial germs to subside and eventually make people sick. This problem was partially improved upon when containers such as bottles and jugs were created to reduce vulnerability to disease, yet the decision was still made that these containers needed to be closed off while not in use. This was done most in part with corks until caps and lids were created. They were designed with a means to grab into the flange in the opening of containers when pressed over the top.

This, however, made the reuse of the containers and the liquids therein difficult. An early ramification was made to be the improvement in bottle stoppers. A device which was designed for a stronger, longer hold as bottles stood idle. The artwork was however dated, and its main drawback was that it required the user to exert extra force to open and close. The flip-top closure improvement later came along. A device that held itself in a sealed state, yet, had many moving parts. The crown cork and the screw cap came along and changed how bottles were closed.

In a social setting, screw caps are the robust solution, but are often lost or defiled. Screw caps with tamper proof rings were the improvement, having a means for the cap to stay connected to the mouth of a bottle, but are a nuisance to drinking as the cap scratches the nose and/or mouth. The crown cork was the most implemented closure with glass bottles but required the user to find a bottle opener or otherwise use the inside of their garment to pry open the bottle. A crown cork with a peel top was later created, but its drawback was that it was time consuming in manufacturing for the products assigned to it.

As simple as they were, there was still a demand to serve liquids through container closures. In Korea, a lid with a pull-out spout was created. However, this mechanism was reduced to cans and perhaps jars. No ramifications were made for bottles. All artwork described thus far involves the user's hands and fingers to operate in directly over the mouth of bottles, providing no sanitary value. Society has moved towards the need to "grab and go" as well as the tolerance for sharing with the intolerance for germs.

Once a closure is removed, the contents of the container remain vulnerable to foreign objects until disposal. Cups are provided when drinks are meant to be distributed among many users, however, in time-constricted events, users share drinking contents either through mouth-to-mouth or a technique where the head is tilted backward, and the contents are poured carefully over the mouth where accuracy is an issue.

SUMMARY

While these closures did serve their primary goal, none of them provide precise pouring as with the accupour* embodiment. This refers to the displaced spout within the cap which is hydro-dynamically designed to shoot a stream of liquid with a minimal amount of tilt. Within the same regards, the present device embodiments will not be subject to misplacement nor contamination or any event that will leave the inner contents vulnerable to foreign objects. The prior-art has a higher bypass rate of germs and critters as the user has to consciously close the container manually. The present device embodiments include a memory recoil which is the primary function in most aspects. These embodiments also include a lever in which provide the "grab and go" operation.

DETAILED DESCRIPTION

Advantages

The embodiment is predetermined to the lifetime of a bottle article. There is no need to for the user to source an additional party to obtain the present embodiment. It erects and retracts a spout for face level accuracy in pouring liquids. Pouring at a distance from the face allows for sharing in events where drinking receptacles aren't provided. While in motion, the device embodiment relieves the forethought of opening a canister with both hands. While idle, the auto-retraction of the spout closure visually and physically provides a means of sanitation. In an industrial scope, the device reduces labor in clean-up, packaging and storage.

BRIEF DESCRIPTION OF DRAWING FIGURES

FIG. 2 is the engaged state of the present invention in its current positioning.

Figure 1:
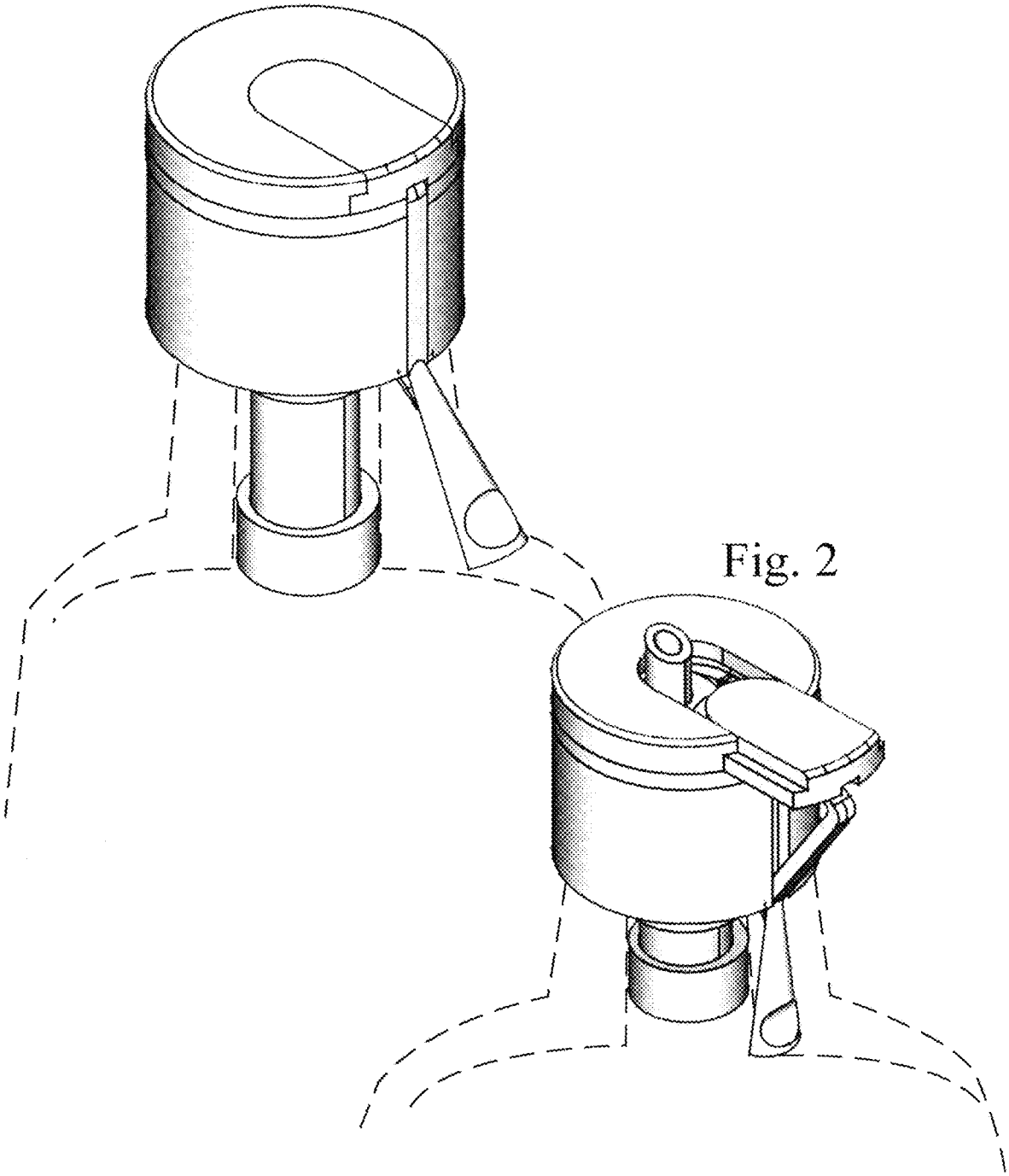
FIG. 1 is the positioning of the present invention in its idle state.

| Drawing Reference Numerals | |
|---|---|
| 1 | Cap Body |
| 2 | Sliding Spout |
| 3 | Accutip* |
| 4 | Inner Tunnel |
| 5 | Spout Funnel |
| 6 | Arm |
| 7 | Lever |
| 8 | Sliding Seal |
| 9 | Seal Sheath (Bottom) |
| 10 | Seal Sheath (Top) |
| 11 | Cap Body Strip Slits |
| 12 | Seal Sheath (Bottom) Slits |
| 13 | Strips |
| 14 | Strip Channels |
| 15 | Hing Channel |
| 16 | Memory Recoil Tongue |
| 17 | Swivel |
| 18 | Arm Channel |
| 19 | Cork Bed |
| 20 | Arm Groove |

DESCRIPTION OF THE PREFERRED EMBODIMENTS

The erecting spout cap shown in FIG. 1 is a closure to the mouths of bottles. In many aspects, these bottles will have necks or flutes. FIG. 1 shows how each embodiment fits to the predetermined dimensions of the customary bottle. FIG. 2 shows the engaged resolution, erecting a spout for pouring at the operation of a finger lever.

Figure 3:
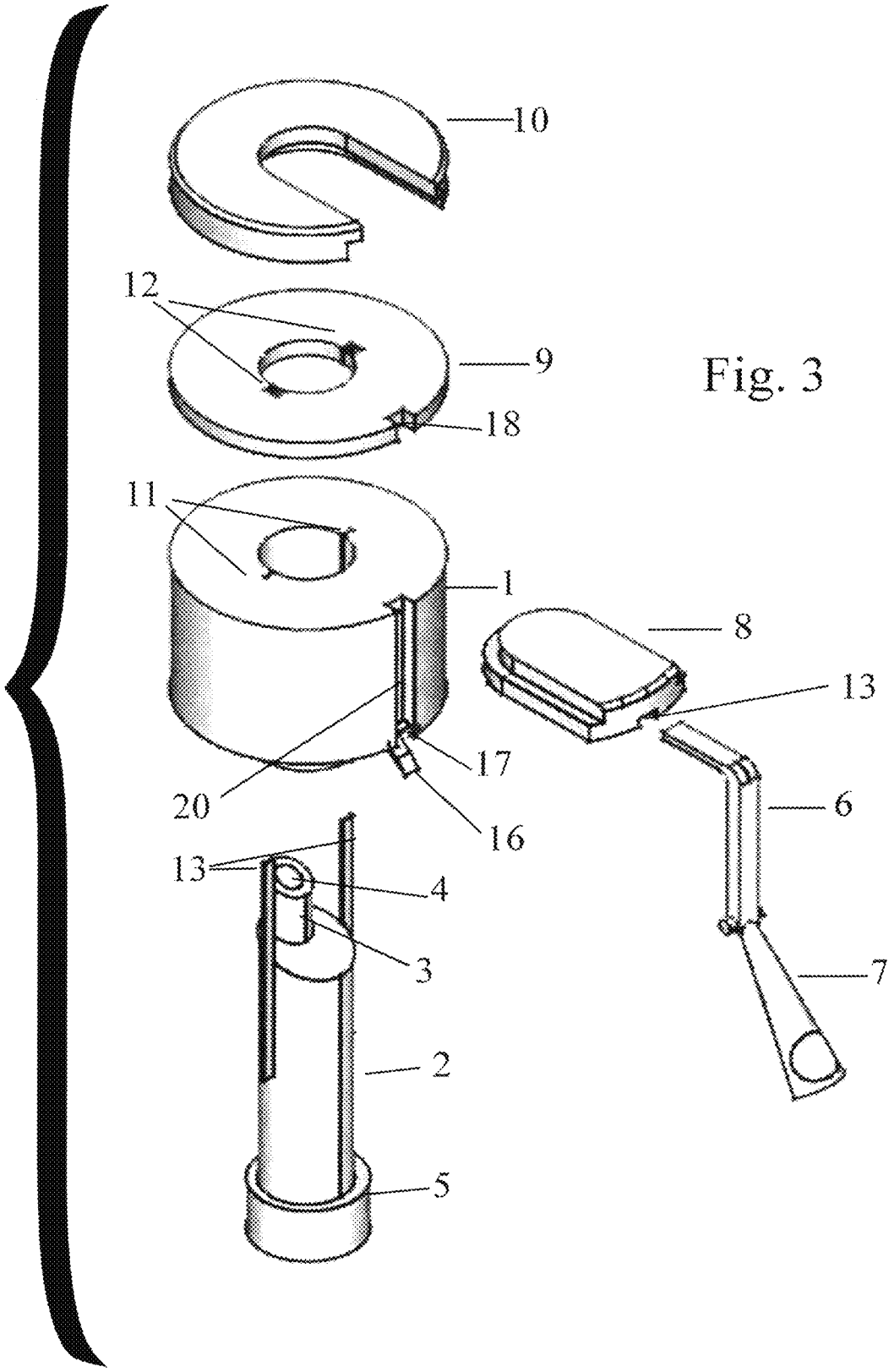
FIG. 3 is the exploded view of the embodiments of the current invention.
Figure 7:
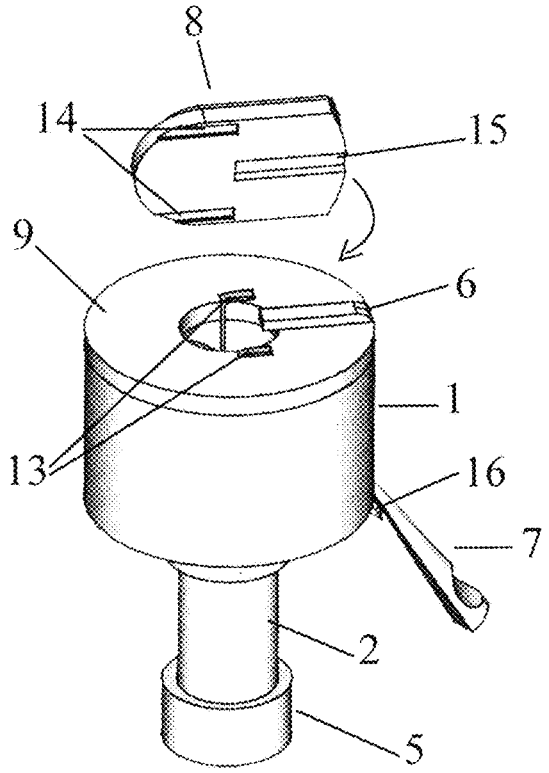
FIG. 7 is the placement of the cap body and bottom seal sheath in relation to the strips.

FIG. 3 illustrates an exploded view of a cap body 1, a sliding spout 2, an arm 6 and lever 7, a sliding seal 8, a seal sheath (bottom) 9, and a seal sheath (top) 10 upon their emergence from the manufacturing mold. When molded, the cap body 1 resembles that of a rigid excavated bagel article for fitting to the exact dimensions of the mouth of a bottle container. It comprises a cap body strip slit 11 in its inner wall structure on opposite sides, flush to an arm channel 18 on the outer frame. The cap body strip slits 11 guide a thin strip 13 on reflective sides into the seal sheath (bottom) 9 as shown in FIG. 7. The strips 13 are what pull the sliding spout 2 through the cap body 1 as is shown is FIG. 5. And FIG. 8. On the exterior frame of the cap body 1, there is a swivel gap 17 at the end of the arm groove 20. The arm 6 and contiguous lever 7 have a pivotal means to snap into the swivel gap 17. Upon snapping into the swivel gap 17, the lever 7 rests on a concave memory recoil tongue 16 and holds the arm 6 in the arm groove 20 in the idle position as shown in FIG. 7 and in FIG. 9. The length of the memory recoil tongue 16 varies due the materials used in manufacturing. The softer the polymeric material of the embodiment, the more uniform the length of the memory recoil tongue 16 in the sane aspects, however, for more rigid material, the memory recoil tongue 16 will serve the length of the lever 7 up 80% (not shown). Also, the memory recoil tongue 16 can originate with the manufacturing mold or be added accordingly based on the type of materials used.

Figure 4:
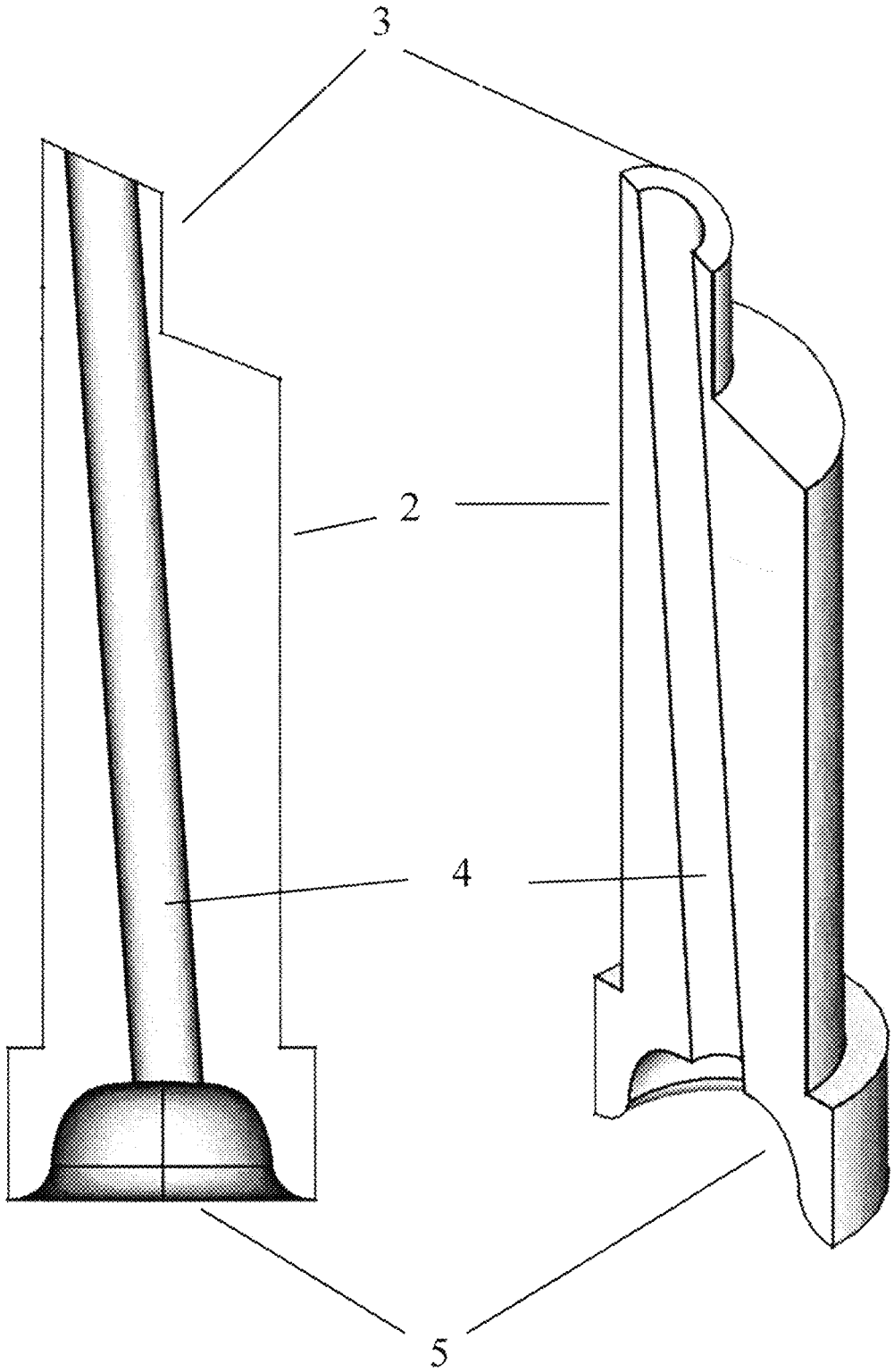
FIG. 4 is the hatched flush view and hatched perspective view of the spout embodiment

FIG. 4 illustrates a tilted inner tunnel 4 in a hatched view of the sliding spout 2. As, shown in FIG. 3, the sliding spout 2 comprises an accutip* 3 succeeding the flow of liquid through the embodiment shown in FIG. 4. The accutip* 3 is a narrow structure that gives the spout clearance upon erection. A spout funnel 5 precedes the flow of liquid through the sliding spout 2. The spout funnel 5 has an outside diameter greater than the outside diameter of the sliding spout 2, enclosing the inner neck of the bottle, preventing the engulfing of liquid throughout the entirety of the present embodiment. The direction of the flow of liquid is controlled by the accutip* 3 providing the present pour service hereby known as accupour*.

Figure 5:
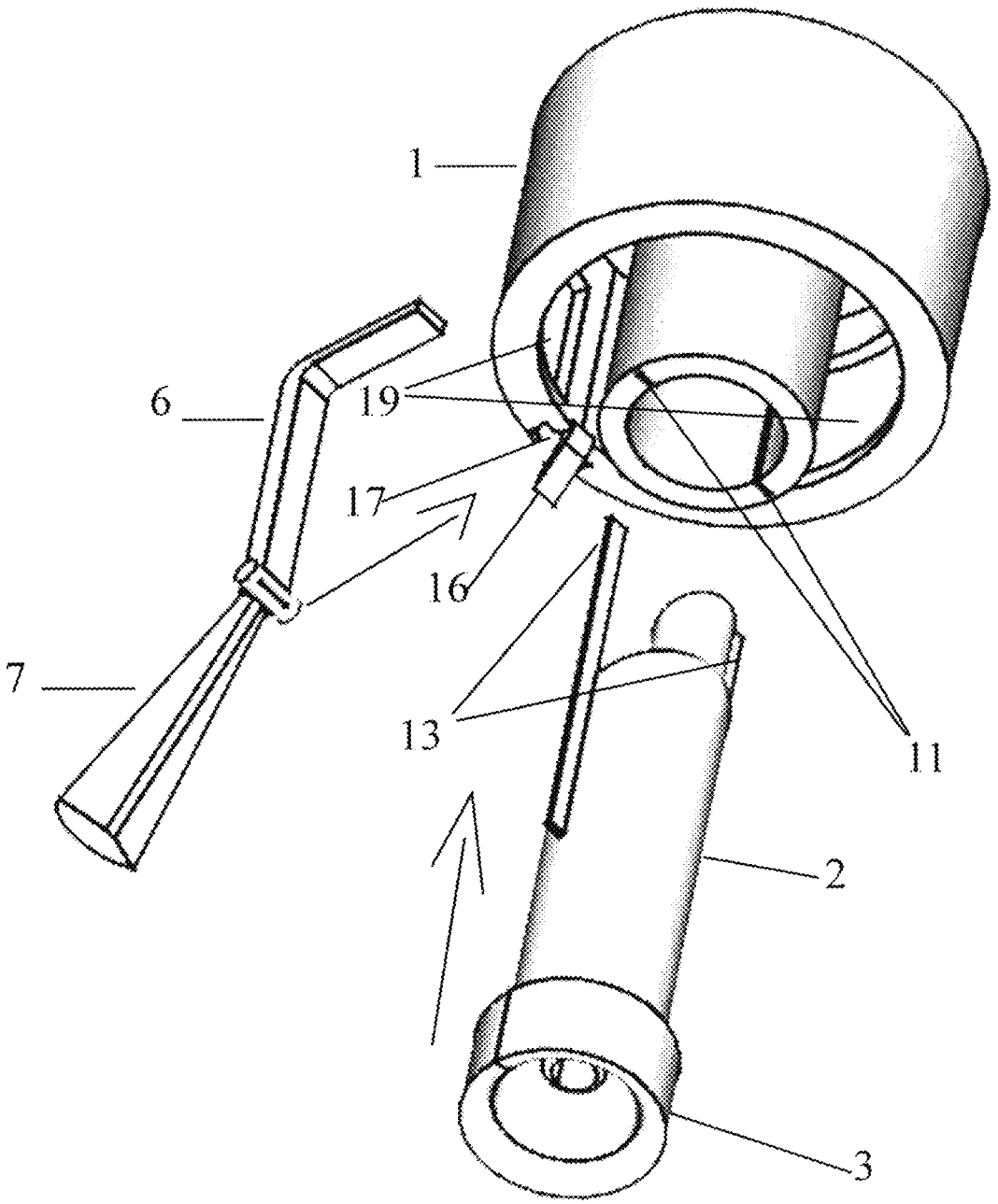
FIG. 5 shows the placement destination of the spout and lever towards the cap body.
Figure 8:
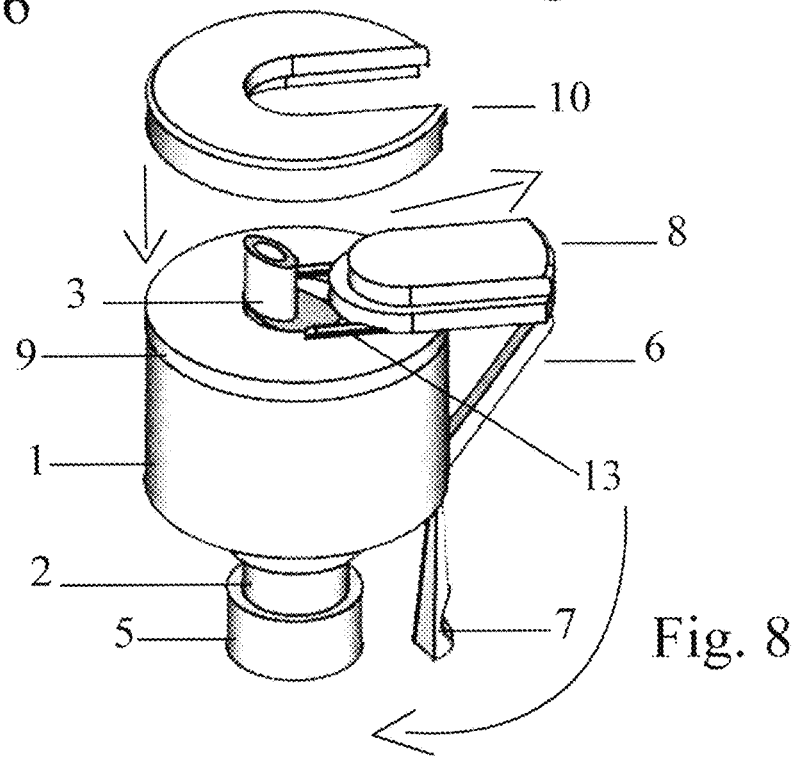
FIG. 8 shows the final steps of assembly

FIG. 5, introduces a cork bed 19 inside the annular side wall of the cap body 1 for firm holding in shipping and storage. In other aspects, this area, with spacing allowed, will serve a means of threading to screw and seal the closure embodiment to the mouth of a bottle (not shown). FIG. 5 in addition, shows the attachment of the thin strips 13 to the sliding spout 2. They fit into the cap body strip slits 11 from underneath the cap body 1. The outer diameter of the sliding spout 2 is equal to the diameter innermost wall of the cap body 1. The strips 13 are placed on opposite sides of the sliding spout 2, adhering to the bottommost inner flank of the strips, allowing the strips to release from the sliding spout during erection. The strips 13 are engaged by the sliding seal 8 as shown in FIG. 8.

Figure 6:
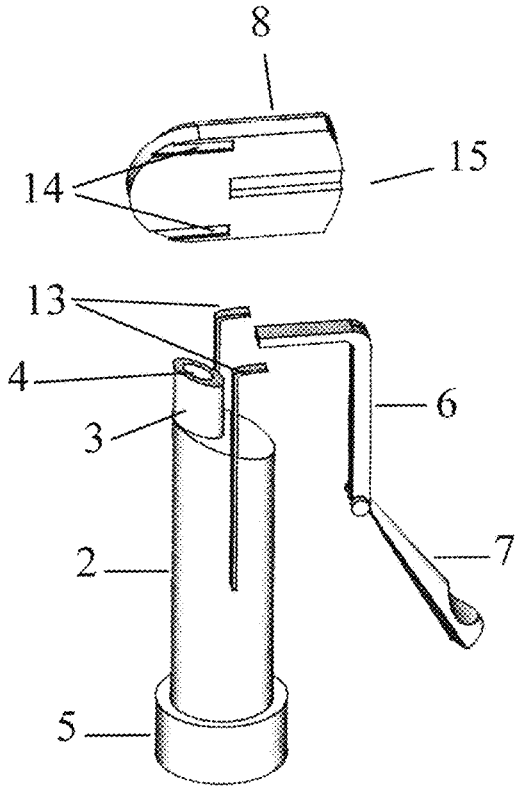
FIG. 6 shows the channels beneath the sliding seal and the placement of the strips and arm.

FIG. 6 reveals the underlining of the sliding seal 8. It is molded with a strip channel 14 on opposite flanks of the nose of the sliding seal 8 to which the strips 13 adhere flush to its centermost vertical edge. A hinge channel 15 rears the sliding seal 8 to which the arm adheres to its centermost vertical edge, serving as a curling release hinge. FIG. 7 demonstrates the depth of the sliding spout 2 in relation to the seal sheath (bottom) 9. Once measured properly, the adhered strips 13 are fitted through a seal sheath (bottom) strip slit 12 on complimentary sides of the seal sheath (bottom) 9 and folded toward the arm 6 for adhering. An arm groove 20 is pre-molded to the rear of the seal sheath (bottom) 9 to which the arm 6 lay idle. First, the strips 13 adhere to strip channels. Upon stronghold, slide back the sliding seal 8 as to adhere the arm 6 to the hinge channel 15 as shown in FIG. 8. The sliding seal 8 locks into the seal sheath (top) 10. The inner diameter of the seal sheath (top) 10 is equal to the inner diameter of the seal sheath (bottom) 9, the inner diameter of the cap body 1, and the outer diameter of the sliding spout 2 not including the diameter of the spout funnel 5. In FIG. 8 the embodiments are measured for operative accuracy before the top seal sheath 10, the bottom seal sheath 9 and the cap body 1 adhere together.

Figure 9:
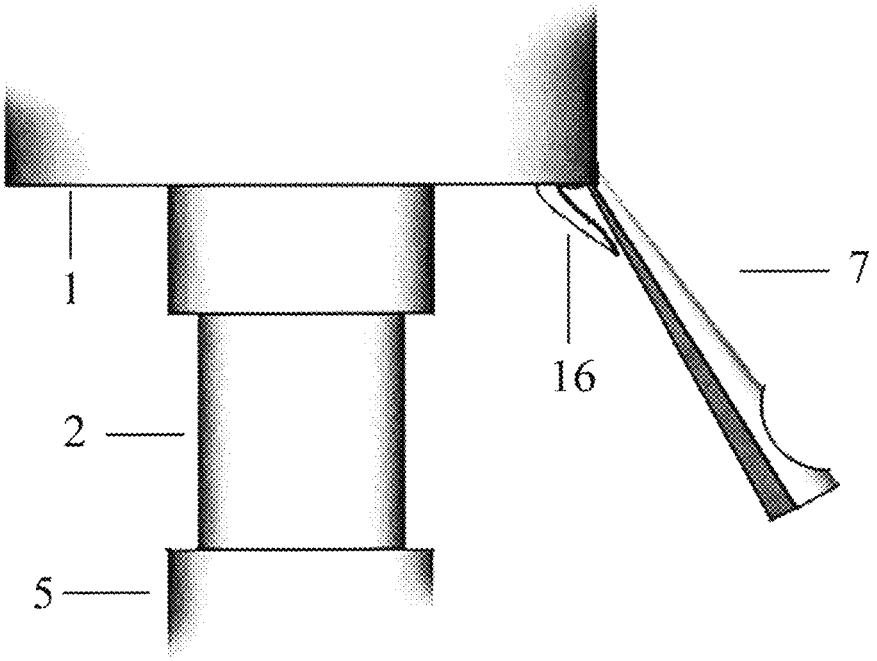
FIG. 9 is the close-up of the auto-recoil tongue at its idle state.
Figure 10:
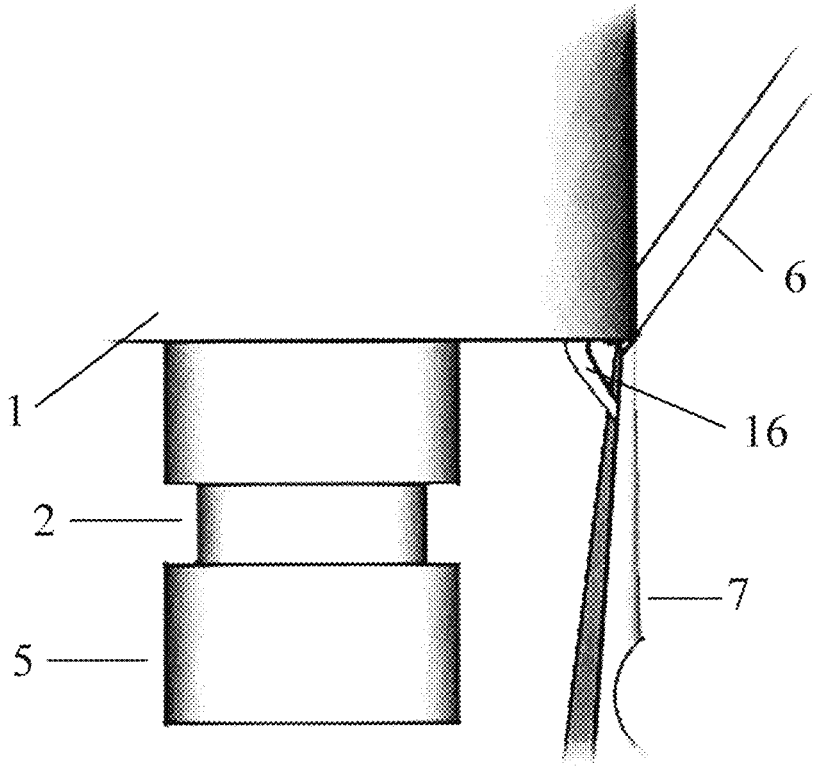
FIG. 10 is the close-up of the auto-recoil tongue engaged by the lever.
Figure 11:
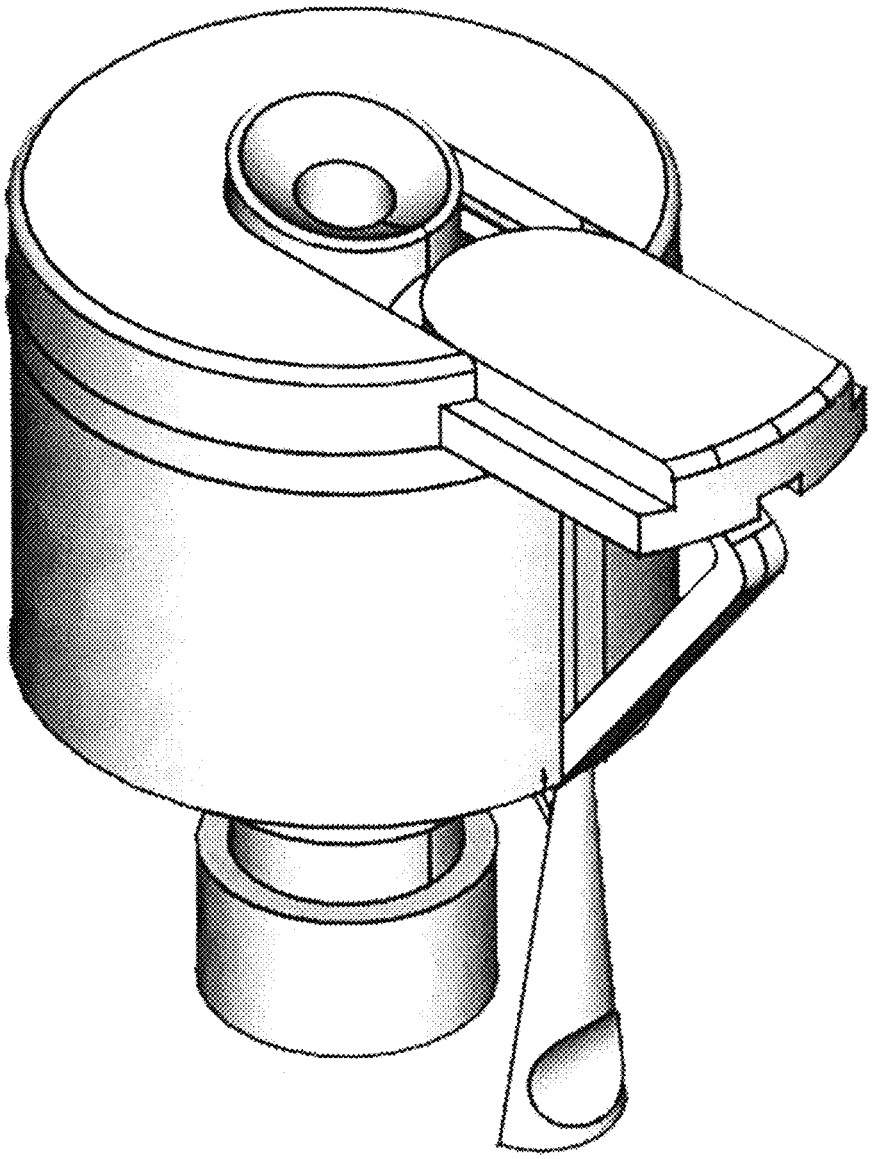
FIG. 11 is a ramification aspect to the displaced spout.

FIGS. 9 and 10 show the relationship between the memory recoil tongue 16 and the lever 7. The memory recoil tongue 16 is not limited to length or height as to comply with the calculation of range of motion. The memory recoil tongue 16 auto-retracts the lever 7 and the sliding spout 2 and closes the sliding seal 8.

Operating this closure embodiment provides a "grab-and-go" action. As the user places their hand around the neck of the bottle product, the index finger presses the lever 7. Said lever draws the sliding seal 8 forward. With the thin strips 13 attached to the strip channels 14 and the upper register of the sliding spout 2, the strips erect the spout through the opening of the seal sheath (top) 10 for the duration of the user's grip. Upon the release of the user's finger, the memory recoil tongue 16 engages the lever 7 thus, retracts the service embodiment and seals the closure article.

The embodiments of the present device (a) are of comprehensive use by persons of any age, (b) provide a single-handed operation over the cognitive two-handed twist or pull motion, (c) has sanitary value for the containment of liquids both ingestible and industrial, (d) when used for beverages, can serve the user away from the opening of the mouth without tilting the head backward, making the sharing of beverages robust, (e) keeps the user's hands completely beneath the mouth of the bottle during operation, (f) provide economic value as the device requires no exclusive retail market share, and (g) provide implied value on a commercial level as the following variations are considered.

For products that do not require reclose, the memory recoil tongue 16 can be omitted in manufacturing and neck grips (not shown) can be added to the lever 7 for clamping, keeping the embodiment of the spout 2 erect until disposal of the entire product. As a tamper-proof measure, the top of the device can have a slight perforation between the sliding seal 8 and the seal sheath (top) 10. In aspects where the present closure embodiment is made of cork or wood, the memory recoil tongue 16 can be a concave sheet of metal and added after the manufacturing of the closure embodiment. In instances where the device is made of metal, the bottom of the seal sheath 9 can be omitted during manufacturing. Although there are specificities mentioning assembly through adhesion, the device can be assembled by push-pegs and holes and/or lock lugs and twist slots, for example, on the polar sides in the seal sheath (bottom). Instead of a touch lever mode, the device can be all slides. Depending on the bottle product, the size of the device will vary as well as the embodiment of the spout and recoil. In modes when the present serving embodiment is not used for beverages, the accutip* 3 can be omitted and have the inner tunnel centered through the sliding spout 2 in manufacturing. In various cases, the color and form of the present device can be determined by the manufacturer based on brand identity, universal safety measures, and product innovation.

Hereby, with all elements considered in the present embodiment, an array of variations and modifications will now become apparent to those skilled in the art. Accordingly, the scope should be determined not by the embodiments illustrated, but by the appended claims and their legal equivalents.

Glossary

Accupour—Hydrodynamic design to serve with acute precision.

Accutip—The acute stem opening to a spout.

What is claimed is:

1. A closure device for manually erecting and retracting a serving spout, comprising:

a cap body having a top surface having a centrally disposed channel therein formed by an inner wall structure that includes at least one strip slit formed therein;

a sliding spout having at least one strip having a first end connected thereto, each respectively received within the centrally disposed channel and the at least one strip slit;

a top seal sheath arranged over the top surface of the cap body and having an opening defined therein and configured to slidingly receive a sliding seal therein;

a second end of the at the least one strip connected to the sliding seal, thus interconnecting the sliding spout with the sliding seal;

an arm connected at a first end thereof to the sliding seal and having a lever at a second end thereof, the arm and lever being pivotally connected to the cap body by a pivotal connection;

wherein, actuation of the lever about the pivotal connection causes the sliding seal to slide within the recess in the top seal sheath to an open position, and to thus cause the sliding spout to slide from a retracted position within the cap body to an erected position extending out of the cap body and through the recess in the top seal sheath.

2. The closure device according to claim 1, further comprising:

a bottom seal sheath arranged between the top surface of the cap body and a bottom surface of the top seal sheath.

3. The closure device according to claim 1, further comprising:

a memory recoil tongue positioned on the cap body, which holds the arm and lever in an idle position prior to actuation of the lever, and upon release of the lever retracts the lever and the sliding spout and closes the sliding seal.

4. The closure device according to claim 3, wherein the memory recoil tongue is integrally formed with the cap body.

5. The closure device according to claim 3, wherein the memory recoil tongue is connected to the cap body.

6. The closure device according to claim 5, wherein the memory recoil tongue is formed of metal.

7. The closure device according to claim 1, further comprising:

an arm groove formed in the cap body, wherein the arm is received within the arm groove in an idle position prior to actuation of the lever, and upon release of the lever.

8. The closure device according to claim 1, further comprising:

a second strip slip formed in the inner wall structure opposite to the at least one strip slit;

a second strip connected at a first end thereof to the sliding spout, received within the second strip slit, and having a second end thereof connected to the sliding seal.

9. The closure device according to claim 1, wherein the sliding seal further comprises:

at least one strip channel formed in a first end thereof for receiving the second end of the at least one strip; and a hinge channel formed in a second end thereof for receiving the first end of the arm.

10. The closure device according to claim 1, wherein the sliding spout further comprises a spout funnel formed on a bottom end thereof and a tip formed on a top end thereof.

11. The closure according to claim 10, wherein the spout funnel has an outside diameter greater than an outside diameter of the sliding spout.

* * * * *